United States Patent [19]

Lautenschläger

[11] 4,322,870

[45] Apr. 6, 1982

[54] HINGE FOR ALL-GLASS DOORS OF CABINETS

[75] Inventor: Gerhard W. Lautenschläger, Brensbach-Wersau, Fed. Rep. of Germany

[73] Assignee: Karl Lautenschläger KG., Mobelbeschlagfabrik, Odenwald, Fed. Rep. of Germany

[21] Appl. No.: 927,966

[22] Filed: Jul. 26, 1978

[30] Foreign Application Priority Data

May 9, 1977 [DE] Fed. Rep. of Germany ..... 2739939

[51] Int. Cl.[3] ..... E05D 7/04

[52] U.S. Cl. ..... 16/235; 16/357; 16/378

[58] Field of Search ..... 16/149, 131, 135, 191, 16/142, 158

[56] References Cited

U.S. PATENT DOCUMENTS

| | | | |
|---|---|---|---|
| 1,505,029 | 8/1924 | Kellerman | 16/135 |
| 4,177,450 | 12/1979 | Gorton | 16/191 |

FOREIGN PATENT DOCUMENTS

| | | | |
|---|---|---|---|
| 2325057 | 3/1973 | Fed. Rep. of Germany | 16/158 |
| 700190 | 5/1966 | Italy | 16/144 |

*Primary Examiner*—Doris L. Troutman

[57] ABSTRACT

A hinge for all-glass doors on cabinets, having a part to be fastened to the all-glass door, which is pivoted on a part which can be fastened to the supporting wall of the cabinet, wherein the supporting wall hinge part is formed by an elongated metal fitting which is disposed in the corner area of the glass door, overlapping the margin thereof, and having a recess which is open on the inside of the door and at the end facing the supporting wall, in which recess there is fastened releasably a mating insert of metal, the supporting wall hinge part being pivoted on this insert.

9 Claims, 4 Drawing Figures

HINGE FOR ALL-GLASS DOORS OF CABINETS

BACKGROUND

The invention relates to a hinge for all-glass doors of cabinets, having a part which can be fastened to the glass door and which is pivotingly attached to a part which can be fastened to the supporting wall of the cabinet.

In recent years, there has been a growing trend in the furniture manufacturing industry toward the use of all-glass doors on cabinets or vitrines, i.e., glass doors without wood frames. For the pivoting of the doors on the supporting wall of the cabinet, a series of hinges have been developed which have proven entirely practical. In these known hinges, the door part of the hinge is as a rule fastened in a cutout extending along the vertical edge of the door from a point just below the upper edge to a point just above the bottom edge of the glass door, the door being gripped thereby in the area surrounding the cutout. The visible outside of the door part of the hinge is usually in the form of a metal decorative plate (see, for example, German Pat. No. 19 60 406). The door cutout required for the fastening of the door part of these hinges extends to a considerable extent into the door from its vertical edge. In the preparation of this cutout and in the subsequent installation of the door part of the hinge, breakage of the glass door can occur, especially if the hinge is not installed in a stress-free manner. Furthermore, in many cases the necessarily great width of the decorative plates is undesirable for esthetic reasons.

THE INVENTION

The object of the invention, however, is to create a glass door hinge which can be disposed in the upper and lower corner areas of the glass door on the horizontal edges thereof, and which at the same time will be very slender so as to be as inconspicuous as possible. Furthermore, the danger of breaking the glass door when installing the hinge or in preparing the door for such installation is to be reduced and the installation itself is to be simplified.

Setting out from a hinge of the kind mentioned above, this problem is solved in accordance with the invention in that the supporting wall part of the hinge is formed by a slender, elongated metal fitting disposed in the corner area of the glass door and overlapping its edge, and having a recess which is open on the inside of the door and at the end facing the supporting wall and in which a mating insert of metal is removably fastened, and in that the supporting wall part of the hinge is pivoted on this insert. In the hinge thus constructed, the slender fitting which overlaps the horizontal edge of the door can be cemented to the edge before the door is mounted on the cabinet carcass, so that a stress-free mounting of the fitting on the door is achieved. The actual mounting of the glass door on the cabinet is then performed by first loosely mounting the supporting wall part of the hinge on the supporting wall together with the insert, and then attaching the glass door to the cabinet carcass such that the recess in the fitting mates with the already installed inserts, and then the inserts are fastened into the fitting. Then the precise adjustment of the glass door can be accomplished by the displacement of the loose supporting wall part of the hinge. When the door is in the correct position, the supporting wall part of the hinge is then, as usual, fixed by tightening its fastening screws. Instead of the above-mentioned cementing, the fittings can also be clamped onto the edges of the glass doors by means of set screws, in which case it is recommendable to interpose resilient inserts in the marginal areas covered by the fitting for the avoidance of stresses endangering the glass doors.

In a preferred embodiment of the hinge of the invention, in which the supporting wall part of the hinge is in the form of an elongated supporting arm of approximately U-shaped cross section, which is adjustably attached to a mounting plate affixed to the supporting wall of the cabinet, the recess in the fitting has in plan approximately the shape of an elongated rectangle, whose longer sides extend at right angles to the hinge pivot axis, the insert having a rabbet in the area of articulation of the supporting arm, such that in this area a slot is formed between the fitting and the insert mounted therein, extending at right angles to the pivot axis of the hinge, and the prolonged sides of the supporting arm which are linked to the insert are engaged in this slot. The insert thus completely fills out the recess except for the slots, so that even the back of the door part of the hinge, which is visible when the door is open, presents a smooth, uninterrupted and esthetically satisfactory appearance.

For the fastening of the insert in the fitting, the embodiment can be such, in further development of the invention, that there is provided on the bottom of the recess in the fitting a tenon having a tapped hole, the said tenon fitting into a complementary mortise in the insert, and that in the insert there is provided a through bore in alignment with the tapped hole in the tenon for the accommodation of a fastening screw to be screwed into the tapped hole. The tenon on the fitting, which engages the mortise in the insert, constitutes not only an additional means for securing in position, but is also makes it possible for the tapped hole to have a sufficient length for the fastening screw, so that a single screw will suffice for the secure fastening of the insert in the fitting. In the case of relatively heavy glass doors, two or more screws holding the insert in the fitting can be provided to increase safety.

The through bore in the insert is preferably provided with a counterbore for the head of the fastening screw.

On account of the danger of breakage of glass doors, it is recommendable to provide the hinge with an overtravel stop means to limit its pivoting angle to a given value, the said means being attached at one end to the interior of the supporting arm and at the other to the insert. The design is preferably made such that the overtravel stop means is formed by at least one and preferably two elongated, flat links lying within the sides of the supporting arm, one of the ends of each link being pivoted in a second rabbet within the rabbet provided for the supporting arm, and the other end of the link being pivoted and longitudinally displaceable by a given amount on the supporting arm.

The hinge of the invention can also be constructed in a very simple manner as an over-center hinge by providing an over-center mechanism in the area overlapped by the prolonged sides of the supporting arm, in the form of two detent elements disposed in a bore in the insert and urged slightly out of the bore by spring bias, each of which can snap into an opening or indentation in the sides of the supporting arm when the hinge is in the closed position.

The invention is further explained in the following description of an embodiment, in conjunction with the drawing, wherein.

Figure 1:
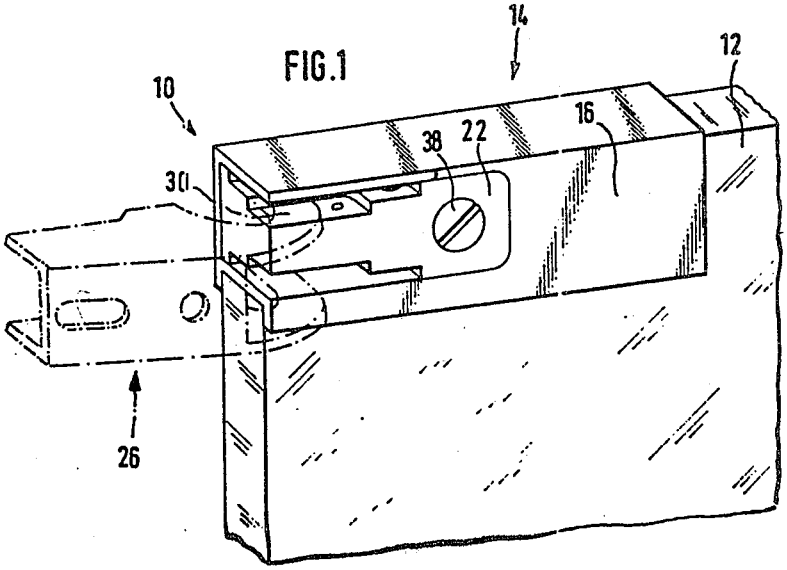
FIG. 1 is a perspective view of a hinge of the invention disposed on the upper horizontal edge of a glass door.
Figure 2:
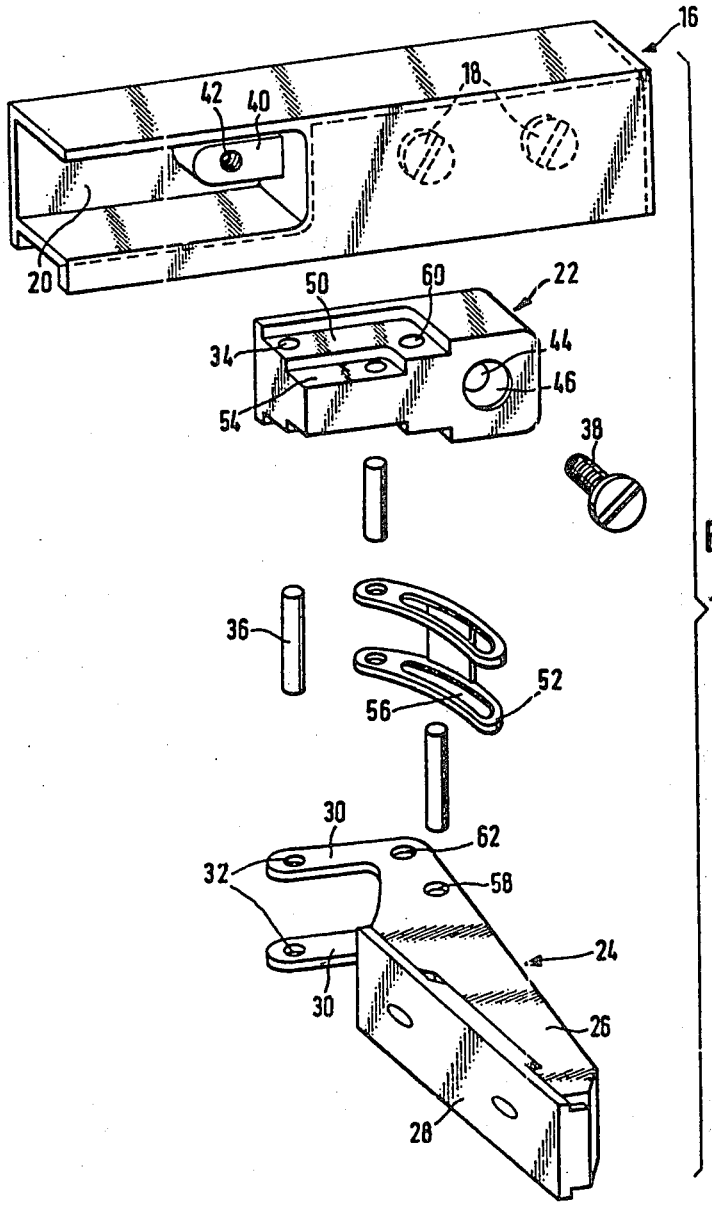
FIG. 2 is an exploded representation of the hinge shown in FIG. 1.

The embodiment of the hinge of the invention, which is shown in FIGS. 1 and 2 and designated as a whole by the number 10 is intended for the hanging of all-glass doors on a cabinet carcass, and specifically the door part 14 of the hinge, which is to be applied to the glass door 12, is to be disposed in the manner shown in FIG. 1 on the upper (and lower) horizontal edge of the glass door 12 so that it will be as inconspicuous as possible. The door part 14 therefore has a slender, elongated fitting 16 of metal, which can be made from zinc (Zamak) by the die-casting method, for example. This fitting 16 is designed so as to fit closely over the edge of the glass door. It is fastened to the glass door preferably by a cement or adhesive that hardens in a stress-free manner, although it can be fastened also by clamping it in place with one or more set screws 18 (FIG. 2), especially when it is to be possible to remove the door part of the hinge from the glass door.

Figure 3:
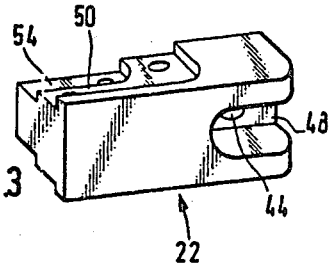
FIG. 3 is a perspective view of the insert of the hinge of the invention in the reverse of the position shown in FIG. 2.

In the fitting 16 a recess 20 is provided which is open on the inside of the door and at its supporting wall end, and it has in plan an elongated rectangular shape whose long sides are at right angles to the pivot axis of the hinge. An insert 22 of metal is fitted closely into this recess and can be fastened therein (FIGS. 2 and 3). The door part 14 of the hinge is thus composed of this fitting 16 of the insert 22 which can be fastened in recess 20 thereof.

The supporting wall part 24 of hinge 10 is constructed conventionally in the form of an elongated supporting arm 26 of U-shaped cross section, which can be adjustably fastened to a mounting plate 28 affixed to the supporting wall of the cabinet.

The sides of the supporting arm 26 are prolonged at the end facing the door part 14 to form projections 30 which closely straddle the insert 22. By means of a pin 36 passing through bores 32 in the ends of projections 30 and a bore 34 in the insert 22, the insert 22 is pivoted on the supporting arm 24. The insert 22 is fastened in recess 20 by means of a screw 38. In order to obtain the required length of thread to accommodate the screw 38 in member 16, a tenon 40 is provided in the bottom of recess 20, and has a tapped hole 42 for the screw 38. The fastening screw 38 is passed through a through bore 44 in insert 22, in line with the tapped hole 42, the outer end of the bore 44 being provided with a counterbore 46 so that the head of the screw 38 will not project from the back of the insert after the installation of the insert in recess 20. The tenon 40 in the bottom of recess 20 mates with a complementary mortise 48 in the insert 22 (FIG. 3).

In the areas in which the projections 30 of supporting arm 26 straddle the insert 22, a rabbet 50 is provided on the top and bottom having a depth equal to the thickness of these projections. When the insert is installed in the door fitting 16, the rabbets 50 thus form slots in the door part 14 of the hinge, which extend at right angles to the hinge pivot axis, and which are entered by the projections 30 of the supporting arm 26.

To limit the opening angle of the hinge to a given value, the hinge 10 is provided with an overtravel prevention means which, in the illustrated case (FIG. 2) is formed by two elongated, flat links 52. These links 52 are disposed on the insides of the sides of supporting arm 26 and their ends facing the door part 14 are pivotingly mounted in secondary rabbets 54 within the first rabbets 50 in insert 22. The articulation of the links 52 in supporting arm 26, however, is such that, in addition to pivoting, a relative longitudinal displacement in relation to the supporting arm is possible to a given extent. For this purpose, slots 56 are provided in links 52, through which a pin passes (not shown) which is held in bores 58 in supporting arm 26.

The further development of the hinge 10 of the invention into an over-center hinge which locks in the closed position can be brought about in a very simple and functionally reliable manner by providing detent means 60 in the form of metal balls contained within a bore extending through the insert and urge apart by a spring, and projecting slightly from the top and bottom of the insert in the rabbets 50 of insert 22 which are overlapped by the projections 30 of the supporting arm, and by associating therewith openings or indentations 62 in the projections 30 of the supporting arm, into which the detent means 60 will snap when the hinge 10 is in the closed position.

Figure 4:
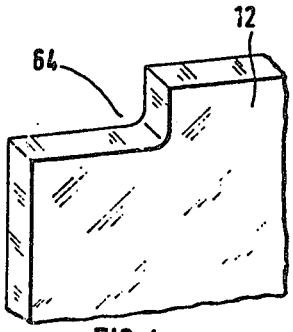
FIG. 4 is a view of the corner portion of a glass door which is to be hung on a cabinet carcass by means of the hinge of the invention.

In order to create the space required in the corner of the glass door 12 to accommodate the recess 20 of fitting 16, the glass door must be provided in the manner shown in FIG. 4 with a notch 64 in its upper corner, which is adapted in shape and dimensions to the recess 20, including the thickness of the wall defining the said recess 20.

I claim:

1. A hinge for a glass door on a cabinet having a supporting wall, said hinge having a first part to be fastened to the door, and a second part to be fastened to said supporting wall, and a pivot axis, said first part comprising an elongated metal fitting to be disposed in a corner area of the glass door, overlapping the margin thereof, and having a recess which is open on that side which is to be located on the inside of the door and at the end to be facing the supporting wall, a mating insert of metal fastened releasably in said recess, said second hinge part being pivoted on said insert and in the form of an elongated supporting arm of approximately U-shaped cross section, which is adjustably attached to a mounting plate to be fastened to the supporting wall of the cabinet, said recess in said fitting having in plan approximately the shape of an elongated rectangle whose longer sides are at right angles to the hinge pivot axis, said insert having a slightly reduced height in comparison with the clear height measured between the longer rectangle side of the recess, so that between said fitting and said insert mounted therein slots extending at right angles to the hinge pivot axis are formed, into which engage extended sides of the elongated supporting arm pivotingly articulated to the insert at their free end area.

2. A hinge according to claim 1, wherein from the bottom of said recess of the fitting a projection provided with a tapped hole projects, which projection fits into a complementary recess in the insert, and wherein a through bore for the passage of a fastening screw which can be threaded into the tapped hole is provided in the insert in alignment with the tapped hole in the projection.

3. A hinge according to claim 1, wherein the through bore in the insert has a counterbore for the head of a fastening screw.

4. A hinge according to any one of claims 1, 2 and 3, comprising an overtravel prevention means engaging the interior of the supporting arm at one end and the insert at the other, said means limiting the pivot angle of the hinge to a given value.

5. A hinge according to claim 4, wherein said prevention means is formed of at least one flat link lying on the inside of the sides of the supporting arm, one of the ends of each link being articulated pivotingly in an area of the insert which is additionally reduced in the height dimension in comparison with said clear height, and the other end of the link being articulated in the supporting arm pivotingly and for longitudinal displacement by a predetermined amount.

6. A hinge according to claim 5, wherein said prevention means is formed of two elongated flat links.

7. A hinge according to claims 1, 2, 3 and 6, comprising an over-center mechanism in the area overlapped by the extended sides of the supporting arm, in the form of two detent elements disposed in a bore in the insert, spring means for forcing said elements slightly out of the bore, each element engaging in an opening or recess in the sides of the supporting arm when the hinge is in the closed position.

8. A hinge according to claim 4, comprising an over-center mechanism in the area overlapped by the extended sides of the supporting arm, in the form of the two detent elements disposed in a bore of the insert, spring means for forcing said elements slightly out of the bore, each element engaging in an opening or recess in the sides of the supporting arm when the hinge is in the closed position.

9. A hinge according to claim 5, comprising an over-center mechanism in the area overlapped by the extended sides of the supporting arm, in the form of two detent elements disposed in a bore in the insert, spring means for forcing said elements slightly out of the bore, each element engaging in an opening or recess in the sides of the supporting arm when the hinge is in the closed position.

* * * * *

UNITED STATES PATENT AND TRADEMARK OFFICE

CERTIFICATE OF CORRECTION

PATENT NO. : 4,322,870

DATED : April 6, 1982

INVENTOR(S) : Gerhard Wilhelm Lautenschlager

It is certified that error appears in the above—identified patent and that said Letters Patent is hereby corrected as shown below:

On The Title Page, Item (30),

"May 9, 1977 (DE) Fed. Rep. of Germany.....2739939" should read -- May 5, 1977 (DE) Fed. Rep. of Germany...2739939 --.

Signed and Sealed this

*Eighth* Day of *June 1982*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,322,870

DATED : April 6, 1982

INVENTOR(S) : Gerhard W. Lautenschläger

It is certified that error appears in the above–identified patent and that said Letters Patent are hereby corrected as shown below:

[30] Foreign Application Priority Data

Sept. 5, 1977 [DE] Fed. Rep. of Germany.... 2739939

This certificate supersedes Certificate of Correction issued June 8, 1982.

Signed and Sealed this

*Seventeenth* Day of *August 1982*

[SEAL]

*Attest:*

GERALD J. MOSSINGHOFF

*Attesting Officer*

*Commissioner of Patents and Trademarks*